United States Patent [19]

McCullough et al.

[11] 3,996,969

[45] Dec. 14, 1976

[54] ADJUSTABLE LOOM

[75] Inventors: George W. McCullough; Henrietta Tragitt McCullough, both of Fort Wayne; Timothy E. Doyle, New Haven, all of Ind.

[73] Assignees: George W. McCullough; Henrietta Tragitt McCullough, both of Fort Wayne, Ind.

[22] Filed: Aug. 15, 1975

[21] Appl. No.: 604,914

[52] U.S. Cl. ..... 139/29; 139/34; 28/15

[51] Int. Cl.[2] ..... D03D 29/00

[58] Field of Search ..... 139/29–34; 28/15, 2; 66/1 A, 4; 35/15

[56] References Cited

UNITED STATES PATENTS

| | | | |
|---|---|---|---|
| 760,919 | 5/1904 | Poole | 139/29 |
| 1,691,527 | 11/1928 | Sakurai et al. | 28/15 X |
| 2,190,813 | 2/1940 | Walker | 139/34 |
| 2,244,085 | 6/1941 | Schneidewendt | 28/15 |
| 2,707,316 | 5/1955 | Doniger | 28/15 |
| 2,985,198 | 5/1961 | Paternayan | 139/33 |
| 3,403,704 | 10/1968 | Reber | 139/34 |
| 3,636,987 | 1/1972 | Forby | 139/34 |

FOREIGN PATENTS OR APPLICATIONS

| | | | |
|---|---|---|---|
| 868,254 | 5/1961 | United Kingdom | 28/15 |
| 711,148 | 6/1954 | United Kingdom | 28/15 |

*Primary Examiner*—James Kee Chi
*Attorney, Agent, or Firm*—Gust, Irish, Jeffers & Rickert

[57] ABSTRACT

An adjustable loom comprising a first adjustable rectangular frame having two spaced, parallel, elongated, rigid uprights of substantially equal length. The uprights are longitudinally hollow. Two rigid, elongated, parallel extending leg members of substantially equal length are rigidly secured at the ends thereof to the lower ends, respectively, of the uprights. The leg members extend orthogonally from the uprights in the same direction. The leg members are also hollow. A first horizontal bar is rigidly secured at the opposite ends thereof to one side of the lower portions, respectively, of said uprights thereby providing a rigid framework of said uprights, leg members and bar. A second rectangular upright frame having two rigid frame elements telescoped into said uprights, respectively, has an elongated, horizontal bar rigidly secured at the opposite ends thereof to the upper ends of the frame elements. Means are provided for adjustably positioning the frame elements in the uprights with said two bars being maintained parallel and horizontal. The first and second bars are mounted on the same sides of the frame elements and uprights.

3 Claims, 6 Drawing Figures

ADJUSTABLE LOOM

BACKGROUND OF THE INVENTION

1. Field of the Invention

The present invention relates to a portable handloom, and more particularly to an adjustable loom of the frame type useful for Navajo type weaving.

2. Description of the Prior Art

Navajo type weaving is a long practiced art of the Navajo Indians. Such weaving has been performed on looms especially made for the particular fabric being woven, such loom not being conventionally adjustable so as to be capable of weaving fabrics of different sizes. A portion of the prior art is outlined in the book "Working With Wool How to Weave a Navajo Rug" by Noel Bennett and Tiana Bighorse, copyrighted in 1971 by Northland Press, Flagstaff, Arizona.

SUMMARY OF THE INVENTION

The present invention relates to an adjustable loom especially useful for the weaving of Navajo type fabrics. Such loom includes a first adjustable rectangular frame having two spaced apart and parallel uprights of substantially equal length. The uprights are hollow. Two rigid elongated parallel, horizontally extending leg members of substantially equal length are rigidly affixed at the ends thereof to the lower ends of the uprights to project from the same side thereof. Said leg members are long enough so as to provide a base on which the aforesaid rectangular frame may be supported. The leg members are also hollow. A first horizontal bar is rigidly secured at the opposite ends thereof to one side of the lower portions, respectively, of the uprights thereby providing a rigid framework of said uprights, leg members and bar.

A second rectangular upright frame having two rigid frame elements are telescoped into said uprights, respectively, an elongated bar being rigidly secured at the opposite ends thereof to the upper ends of the frame elements. The frame elements are adjustably positioned within said uprights and secured there by suitable means such as pins fitting into companion holes such that the two bars are maintained horizontal and parallel. The two bars are mounted on the same sides of the frame elements and uprights so as to provide warp supports spaced from the upright frame parts where they will not interfere with the weaving operation.

It is an object of this invention to provide an adjustable loom of the frame type especially useful for Navajo type weaving.

It is still another object to provide a unique loom structure whereby two upright loom frames can be positioned on a common stabilizing support and adjusted thereon to a desired position.

Still another object of this invention is to provide in a frame loom a moveable stabilizing frame which cooperates with the loom-supporting base, which is separable from the loom apparatus and useable as a warp frame.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figures 1, 2, 4:
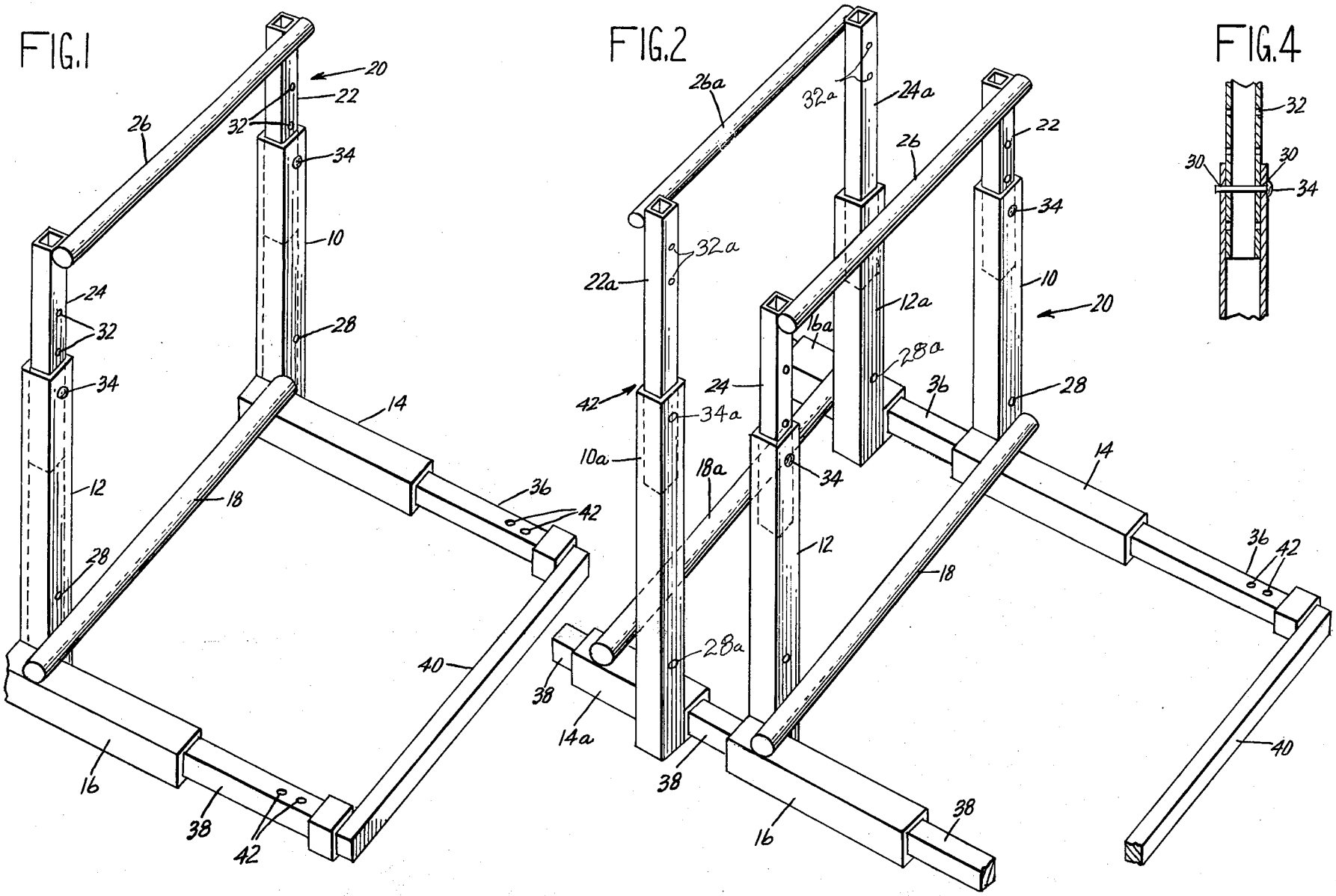
FIG. 1 is a perspective illustration of one embodiment of this invention.
FIG. 2 is a perspective illustration of another embodiment of this invention.
FIG. 4 is a partial longitudinal sectional view taken substantially along section line 4—4 of FIG. 3.
Figure 3:
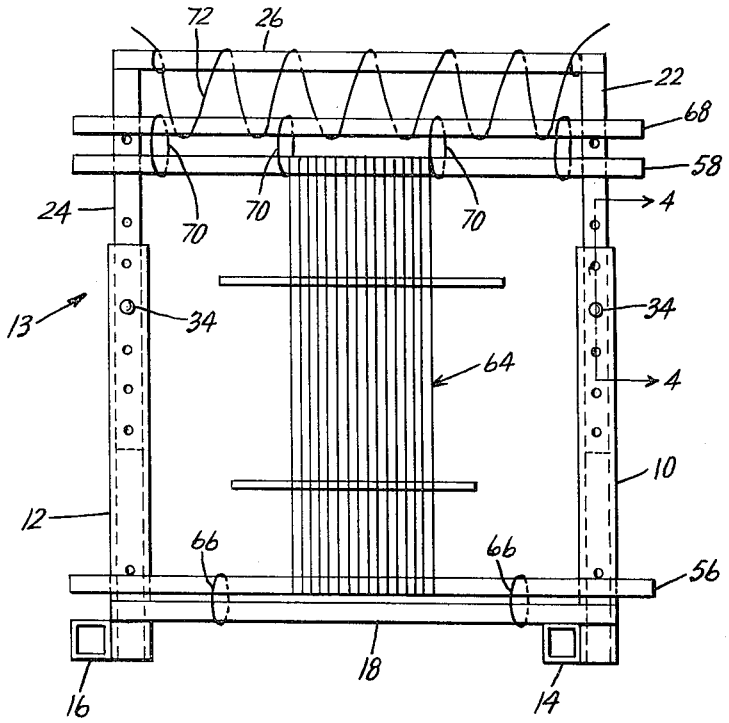
FIG. 3 is a front view of the embodiment of FIG. 1 with a portion of weaving material and accessory weaving devices mounted thereon.

Referring to the drawings, and more particularly to FIGS. 1 and 4, the loom of this invention includes two identical uprights 10 and 12 of square cross-section which are spaced apart and parallel. Secured to the lower extremities of the uprights 10 and 12 are two leg members 14 and 16 of the same cross-sectional shape and size as the uprights 10, these members 14 and 16 being secured at the ends thereof to the uprights 10 and 12 by welding or the like. The members 14 and 16 also extend orthogonally forward from the uprights 10 and 12 so as to provide a supporting base therefor.

Tying the uprights 10 and 12 together is a circular bar 18 suitably welded to the leg members 14 and uprights 10 and 12 on the front or right-hand side of the uprights 10 and 12 as viewed in FIG. 1.

An upper, rectangular frame generally indicated by the numeral 20 is composed of two spaced apart and parallel frame elements 22 and 24 of a cross-section which will slidably telescope into the uprights 10 and 12. To the upper ends of the frame elements 22 and 24 is secured another bar 26 which extends generally horizontal and parallel to the bar 18. Both bars 18 and 26 are disposed on the front side of the adjustable framework composed of the uprights 10 and 12 and the frame elements 22 and 24.

The uprights 10 and 12 are provided with two holes 28 situated, for example, a couple of inches above the bar 18 and two additional holes 34 positioned about an inch below the tops thereof. The frame elements 22 and 24 are provided with a series of longitudinally spaced holes, spaced, for example, four inches apart selectively adapted to receive pins 34 for locking the frame elements 22 and 24 to the uprights 10 and 12, respectively. The pins 34 are easily withdrawn from the companion apertures in the uprights and frame elements such that the bar 26 may be adjusted to a desired distance from the bar 18.

Figure 5:
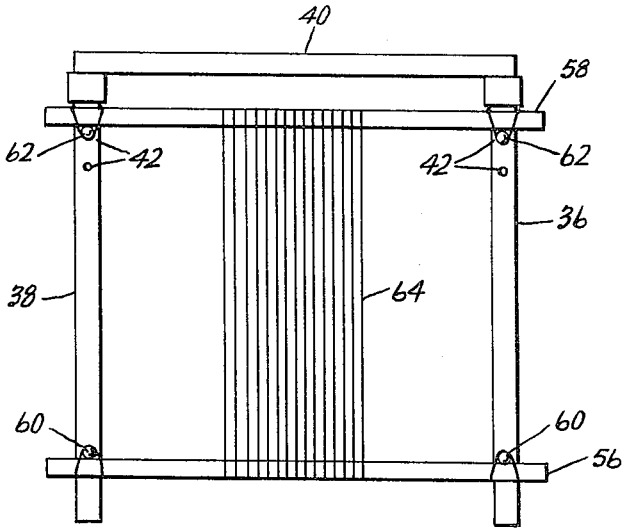
FIG. 5 is an upright view of the stabilizing frame used as part of the supporting base of the looms of FIGS. 1 and 2 but in this instance being used as a warp frame.
Figure 6:
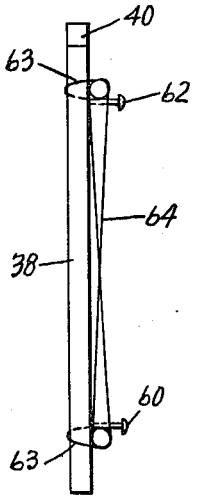
FIG. 6 is a side view of the stabilizing frame of FIG. 5.

The leg members 14 and 16 are hollow to receive slidably and without any undue lost motion two square shaped stabilizing bars 36 and 38 as shown. Secured to the distal ends of the stabilizing bars 36 and 38 is a rigid butt bar 40. This provides a stabilizing frame composed of the bars 36, 38 and 40 which may be removed from the leg members 14 and 16 and positioned upright and used as shown in FIGS. 5 and 6. This stabilizing frame is also intended to be used as a warping frame so is therefor provided with two spaced, one inch, for example, apertures 42.

With the stabilizing frame 36, 38, 40 telescopically received by the leg members 14 and 16, the adjustable loom frame 10, 12, 22, 24, 26 is held in a stable, upright position.

An alternative embodiment of this invention is shown in FIG. 2 wherein like numerals will indicate like parts. This structure is substantially identical to the one shown in FIG. 1 with the exception of the addition of another upright loom frame exactly like the frame 10, 12, 22, 24, 26 with like parts being indicated by the same numerals with the suffix letters *a* added. This loom frame is indicated generally by the numeral 42 and has secured at the lower ends of the uprights 12*a* and 10*a* leg members 14*a* and 16*a*, respectively, which are slidably received onto the ends of bars 36 and 38 telescoped through members 14 and 16. By means of the leg members 14*a* and 16*a*, the upright frame 42 may be adjusted horizontally on the bars 36 and 38.

The upright frame 42 may be moved into abutting relation with the adjustable frame 10, 12, 22, 24 or may be spaced therefrom a desired distance depending upon the techniques being employed by the weaver.

While the structure of the invention thus far described is susceptible of being used in different manners by the artisan, one technique useful in the weaving of a Navajo rug will be briefly described.

One technique involves the removal of the stabilizing frame 36, 38, 40 from the leg members 14 and 16 and positioning it upright as shown in FIGS. 5 and 6. Two wooden dowels 56 and 58 are positioned on one side of the bars 36 and 38 in parallelism and there secured in place by means of pins or nails 60 and 62 inserted into openings 42 at appropriate locations. The dowels 56 and 58 are secured in position by means of rubber bands passed around the nails 60 and 62, the respective stabilizing bar 36, 38 and the dowels 56, 58.

The pins or nails 60 and 62 are on the sides of the dowels 56 and 58 facing each other.

As a first step in the weaving process, a warp is wound in a FIG. 8 over the two dowels 56 and 58 as indicated by the numeral 64. After winding the warp, twining is performed at a location where the warp passes around the dowels 56 and 58 to space the warps at the desired spacing (in some instances eight per inch).

The dowels 56 and 58 with the warp 64 thereon are now mounted on the upright adjustable loom 10, 12, 22, 24, 26 generally indicated by the numeral 13. This is accomplished by lashing the dowel 56 to the bar 18 in parallelism therewith by means of cords 66. The dowel 58 is next lashed to a top, tensioning dowel 68 spaced one inch therefrom by means of suitable cords 70. The top dowel 68 is in turn lashed to the upper rod 26 of the upper frame by means of another cord 72. The frame elements 22 and 24, have been previously appropriately vertically positioned in the uprights 10 and 12 by the pins 34 and cord 72 is tightened so as to tension the warp 64. From this point forward, conventional, Navajo weaving techniques are used to finish the fabric according to the design selected by the weaver. While the weaving is being performed on the upright frame 13, the stabilizing frame 36, 38, 40 may be used by inserting the bars 36 and 38 into the leg members 14 and 16. Different degrees of stabilization may be obtained by inserting the bars 36 and 38 greater depths into the leg members 14 and 16.

The second upright frame 42 as shown in the embodiment of FIG. 2 can also be used as a loom for weaving to provide for a two layered weaving technique by positioning it immediately adjacent to the frame 20. This is a technique which requires no description in this application since it is well known.

The stabilizing frame 36, 38, 40, telescopes into the leg members 14 and 16 for adjusting the degree of stability desired. The stabilizing frame is also useful as a warping frame and is removable from the leg members 14 and 16 for this purpose. All the parts of the apparatus are of rigid stock, preferably metal, securely welded together so as to provide a framework with little or no give which permits facile weaving. By making the verticle frames 20 and 42 adjustable, fabrics of different sizes may be woven. Since the stabilizing frame 36, 38, 40 is of rigid construction, it will not become misaligned during the initial warping stages such that it may be transferred to the adjustable frame 20 to complete the weaving project. The apparatus when disassembled is completely portable and may be stored in a minimum of space. In use it can be adjusted to be extremely stable so that much tension can be applied from various sources. When disassembled, the apparatus has a minimum of projections such that it may be transported in a vehicle, for example, with ease. The horizontal round bars 18, 18*a* are on the same side of the uprights 10, 12 and 10*a*, 12*a*, respectively, so that the latter will not interfere with the weaving operation.

The uprights 10 and 12 are provided with holes 28 at the lower ends thereof which can be used to mount the lower dowel of a warping frame if desired.

Essentially, the primary apparatus may be considered as including two warping frames, the frame 36, 38, 40 and the adjustable, upright frame 20.

In a working embodiment of this invention, the two holes 42 and adjacent bar 40 are 1 inch apart while the holes that receive pins 60 (FIG. 5) are 19½ inches from the adjacent respective holes 42. All holes that receive pins or nails extend completely through the respective member.

While there have been described above the principles of this invention in connection with specific apparatus, it is to be clearly understood that this description is made only by way of example and not as a limitation to the scope of the invention.

What is claimed is:

1. An adjustable loom apparatus comprising a first rectangular frame having two spaced, parallel, elongated, rigid uprights of substantially equal length, said uprights being longitudinally hollow; two rigid, elongated, parallel extending leg members of substantially equal length rigidly secured at the ends thereof to the lower ends, respectively, of said uprights which extend orthogonally therefrom in the same direction, said leg members being longitudinally hollow; a first horizontal bar rigidly secured at the opposite ends thereof to one side of the lower portions, respectively, of said uprights thereby providing a rigid framework of said uprights, leg members and bar;

a second rectangular upright frame having two rigid frame elements telescoped into said uprights, respectively, and a second horizontal elongated bar rigidly secured at the opposite ends thereof to the upper ends of said frame elements; means for adjustably positioning the frame elements in said uprights with said two bars being maintained horizontal and parallel, said first and second bars being mounted on the same sides of said frame elements and uprights, said means including two pins received by companion holes in the upper portions of said uprights and said frame elements, there being a plurality of holes in said frame elements spaced longitudinally thereof whereby said bars may be selectively spaced apart predetermined distances, a rigid stabilizing frame having two parallel extending arms joined at one end thereof by a stabilizing bar, said arms being telescopically received by said leg members, thereby providing an adjustable supporting base for said first and second frames.

2. The loom of claim 1 in which said arms are provided with a plurality of equally spaced apertures adapted, respectively, to receive pins therein.

3. The loom apparatus of claim 1 including third and fourth frames like said first and second frames of claim 1, respectively, said leg members of said third frame telescopically receiving, respectively, said arms of said stabilizing frame thereby providing two loom apparatuses in adjustable juxtaposition, said first and third frames being positioned such that said bars thereof are distally positioned with respect to said respective uprights and frame elements.

* * * * *